United States Patent [19]

Keedy, Jr. et al.

[11] Patent Number: 4,866,822

[45] Date of Patent: Sep. 19, 1989

[54] YARN CRIMPING APPARATUS AND CONTROL THEREOF

[75] Inventors: Vincent W. Keedy, Jr., New Castle; Elwood A. Roth, Seaford, both of Del.

[73] Assignee: E. I. Du Pont de Nemours and Company, Wilmington, Del.

[21] Appl. No.: 192,365

[22] Filed: May 10, 1988

Related U.S. Application Data

[63] Continuation-in-part of Ser. No. 27,189, Mar. 17, 1987, abandoned.

[51] Int. Cl.[4] ..... D02G 1/12

[52] U.S. Cl. ..... 28/250; 28/255

[58] Field of Search ..... 28/248, 250, 251, 255

[56] References Cited

U.S. PATENT DOCUMENTS

| | | | |
|---|---|---|---|
| 3,166,821 | 1/1965 | Furlong | 28/251 |
| 3,526,023 | 9/1970 | Mertens | 28/248 |
| 3,859,695 | 1/1975 | Erickson | 28/250 |
| 3,965,548 | 6/1976 | James, II et al. | 28/251 |
| 4,162,564 | 7/1979 | Stanley | 28/251 X |
| 4,462,143 | 7/1984 | Oswald et al. | 28/251 X |

FOREIGN PATENT DOCUMENTS

| | | | |
|---|---|---|---|
| 141761 | 5/1980 | German Democratic Rep. | 28/251 |
| 143709 | 9/1980 | German Democratic Rep. | 28/250 |
| 49104 | 1/1974 | Japan | 28/250 |
| 918351 | 4/1982 | U.S.S.R. | 28/248 |
| 1161674 | 8/1969 | United Kingdom | 28/250 |

*Primary Examiner*—Robert R. Mackey

[57] ABSTRACT

A process and apparatus for crimping yarn wherein the yarn is introduced to the crimping chamber by means of an injector supplied with steam under constant pressure. The position of the wad in the crimping chamber is controlled by the position of discharge regulation means in response to the fluid pressure above the wad to maintain a space above the wad.

4 Claims, 3 Drawing Sheets

12
10b
10
18
10a
11
10a
14
24
14
25
20
20
13
20
20
16
24a
24b
26
22
16

YARN CRIMPING APPARATUS AND CONTROL THEREOF

CROSS-REFERENCE

This application is a continuation-in-part of our copending application Ser. No. 027,189, filed Mar. 17, 1987 now abandoned.

BACKGROUND OF THE INVENTION

This invention relates to crimping of yarn and more particularly, it relates to an apparatus for crimping and a method for controlling the apparatus.

Stuffer box crimpers are well known and have been widely used for crimping yarns, tows and threads.

The yarn is introduced with the aid of a pair of rollers into a crimping chamber in which it becomes accumulated until its pressure is sufficient to overcome the pressure of the counter pressure device; e.g., a hinged flapper, preventing it from leaving the chamber. In some instances it has been found desirable to introduce into the stuffer crimper chamber a heated fluid under pressure such as steam and utilize the steam to not only assist the crimping process by providing heat and moisture to the yarn in the crimping chamber but also to control the hinged flapper at the outlet of the crimping chamber.

In a stuffer box crimping process, newly delivered yarn is continuously and mechanically stuffed directly onto the top of previously crimped yarn in a filled stuffer chamber, thereby exerting an immediate buckling-type crimping force onto the new yarn. Since there is essentially no space above the yarn within the filled stuffer chamber, the newly introduced yarn is limited to receiving only a folded or two-dimensional crimp due to the buckling forces. It would be advantageous to provide in a crimping chamber process an apparatus and method for providing a space above the yarn previously compacted within the stuffer chamber so that newly introduced yarn is not subjected immediately to buckling-type crimping forces but allowed to develop instead a three-dimensional crimp therein.

SUMMARY OF THE INVENTION

To improve such stuffer crimping processes, this invention provides a stuffer crimping apparatus and process in which the yarn is introduced into the crimping chamber with the aid of a current of fluid under pressure and at a temperature sufficient to set the filaments of the yarn and in which the yarn, under the action of the fluid is crimped and packed under pressure in the crimping chamber against the counter pressure of a hinged flapper in the form of a wad wherein the hinged flapper is responsive to the pressure in the chamber above the wad to provide a space above the wad by controlling wad position, wad density, fluid venting and uniformity of wad extrusion from the crimping chamber. In this process, the heated pressurized fluid not only assists in crimping by setting the filaments and regulates the flapper but also introduces the yarn into the crimping chamber and packs the yarn into the chamber.

The apparatus comprises an injector having a passage therethrough for yarn means for supplying heated fluid under constant pressure to the injector and in a direction to carry the yarn through the injector passage to a crimping chamber wherein the yarn forms a wad, the chamber having a discharge regulation means in the form of a hinged flapper, and means for maintaining a constant space in the chamber above the wad wherein the means includes controlling the fluid pressure in said chamber by controlling the hinged flapper in response to the fluid pressure in said chamber.

DETAILED DESCRIPTION OF THE ILLUSTRATED EMBODIMENT

Figure 1:
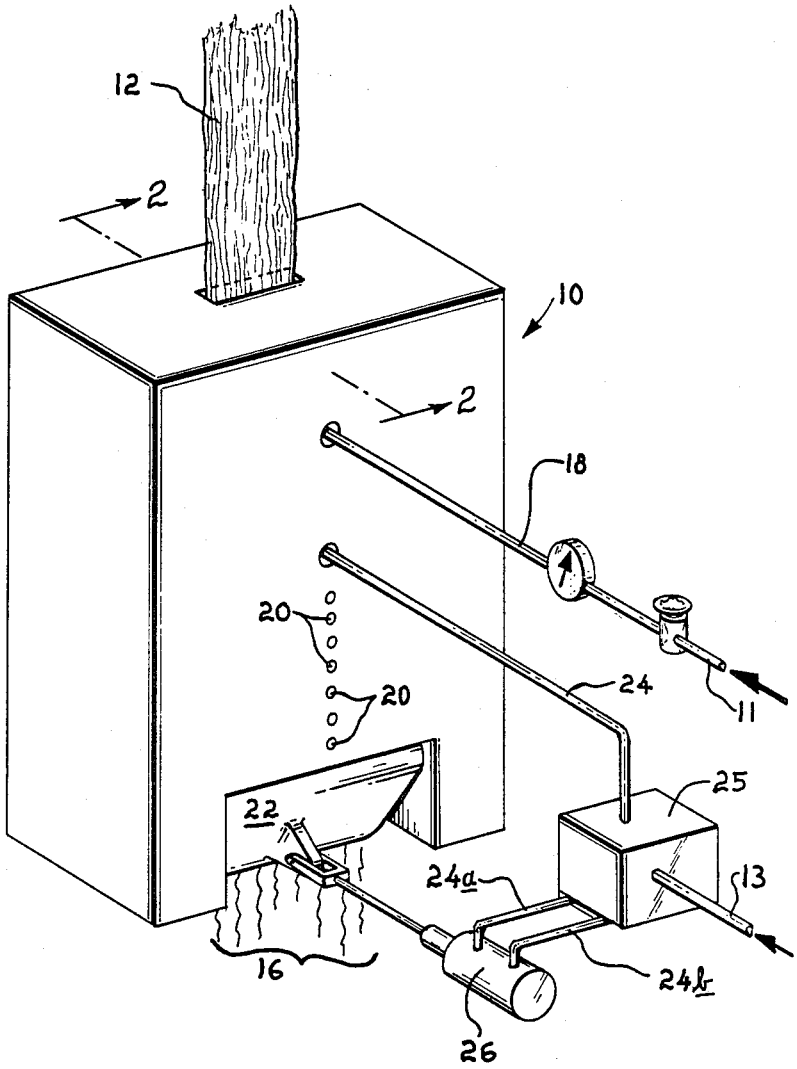
FIG. 1 is a perspective view of the apparatus of this invention.

Referring to the drawings, the apparatus chosen for purposes of illustration includes the stuffer crimping apparatus generally designated 10, a source of pressurized steam fed into pipe 11 and a source of air under pressure fed to pipe 13.

Figure 2:
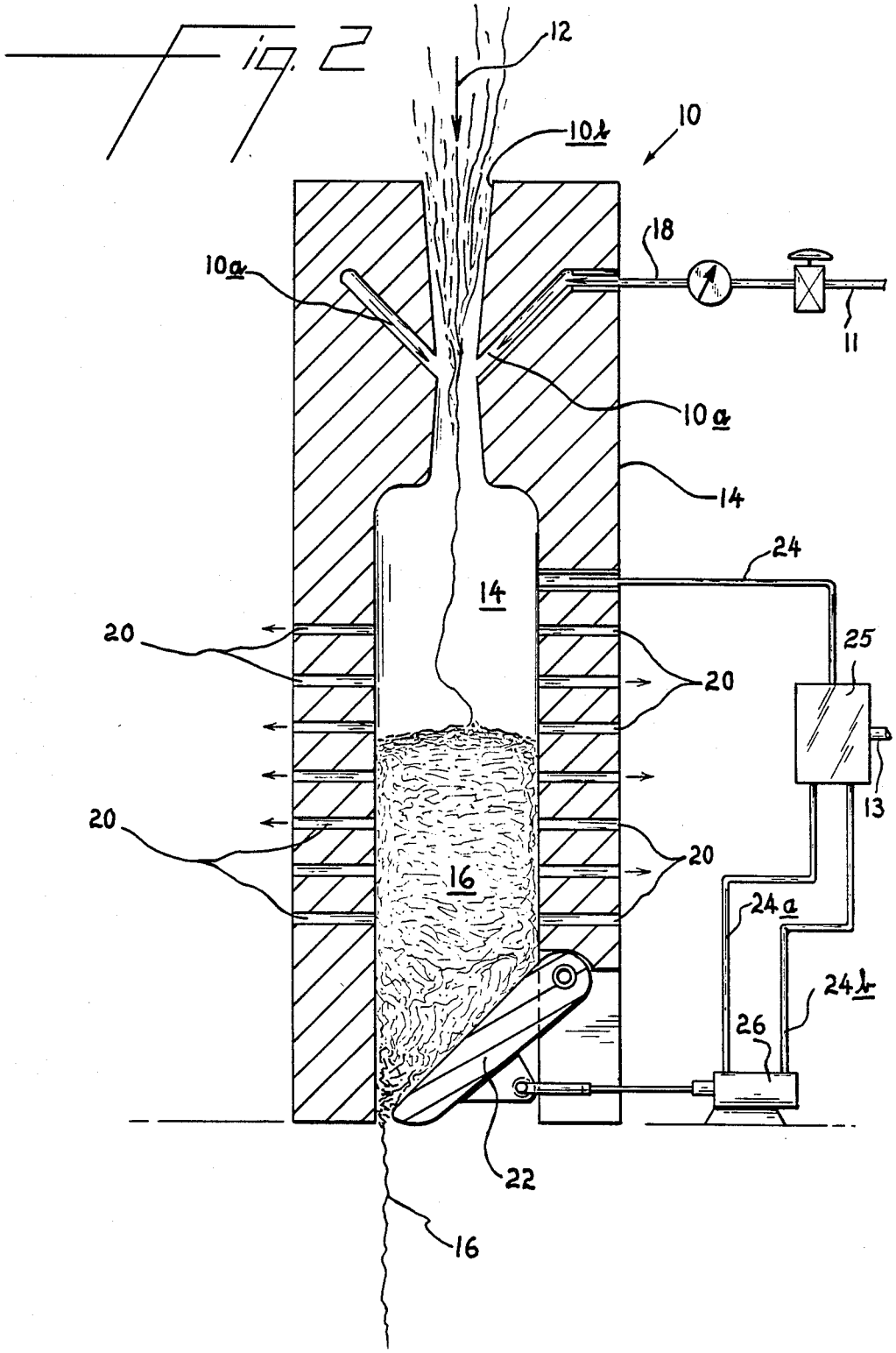
FIG. 2 is a cross sectional view of FIG. 1 taken along line 2—2.

As best shown in FIG. 2, the apparatus 10 includes an integral part an injector formed of downwardly directed passages **10*a* which are supplied with a fluid, e.g. steam, at a constant pressure through pipe 18. The injector has a through passage 10*b* through which yarn 12 passes to crimping chamber 14. A series of ports 20 through the walls of the apparatus lead from the crimping chamber 14 and serve as exhaust ports for the steam. A pipe 24 in communication with the upper portion of chamber 14 is connected to controller 25 which in turn is connected to a source of air under pressure through pipe 13 and to opposite ends of cylinder 26 via pipes 24*a* and 24*b*. The cylinder is fastened to hinged flapper 22 located at the outlet end of the crimping chamber 14**.

Figure 3:
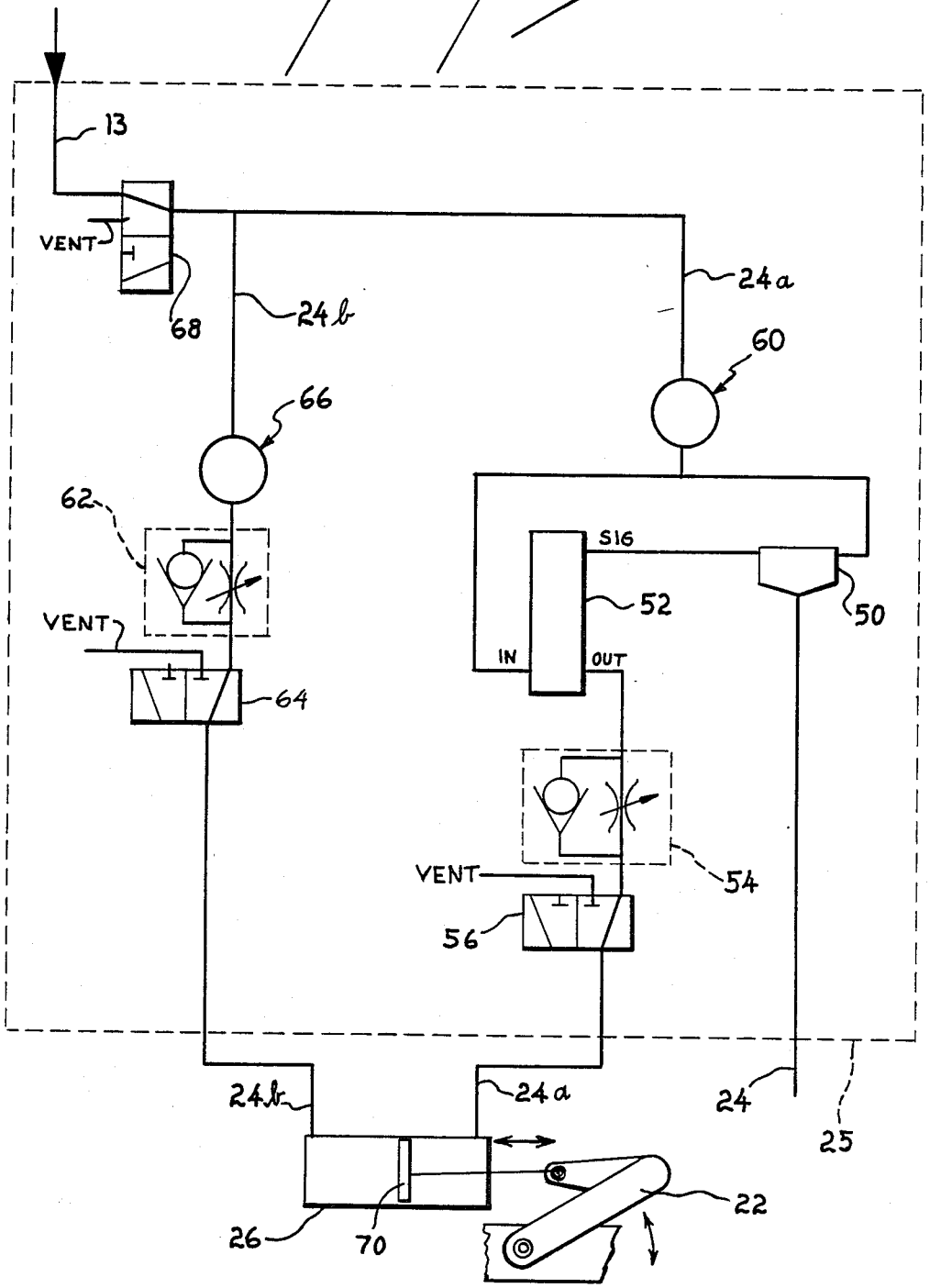
FIG. 3 is a schematic of a controller for controlling the discharge regulation means in response to fluid pressure in the crimping chamber.

Referring now to FIG. 3, the controller 25 which controls the position of piston 70 within cylinder 26 is supplied with air at constant pressure through pipe 13 and flow gate 68 (plug valve with vent Model No. B43VF4, Whitey Company, Highland Heights, Ohio). From flow gate 68 there are two flow paths identified as **24*a* and 24*b* supplying separate pressures through the controller to the cylinder 26. A constant pressure is supplied in path 24*b* via serially connected pneumatic pressure regulator 66 (Mode 10 Fairchild Industrial Products Co., Winston Salem, NC), flow control valve 62 (DYLA-TROL Model No. MF 1-25, Mead Fluid Dynamics, Chicago, IL), and flow gate 64** (plug valve with vent Model No. B43VF4, Whitey Company, Highland Heights, Ohio).

A separate pressure is supplied through flow path **24*a* through pneumatic pressure regulator 60 (Model 10 Fairchild) which in turn supplied air volume booster relay 50 (Model 20 Fairchild), adjustable ratio relay 52 (Model 21 Fairchild), flow control valve 54 (DYLA-TROL Model No. MF 1-25, Mead Fluid Dynamics, Chicago, IL), and flow gate 56 (plug valve with vent Model No. B43VF4, Whitey Company, Highland Heights, Ohio). Pressure in chamber 14 is transmitted via pipe 24 to air volume booster relay 50 which isolates the fluid present in chamber 14 from the pneumatic control system while transmitting a signal representing the pressure in chamber 14 to adjustable ratio relay 52. Relay 52 act to ratio the pressure signal from relay 50 to provide pressure to cylinder 26 in response to the pressure fluctuations occurring in chamber 14**.

Flow gates 56, 64, 68, during constant crimping operation, are set in the closed position. When these gates are opened, they vent fluid pressure to atmosphere. Opening gate 56 results in a venting of pressure supplied to cylinder 26 via pipe 24*a*, thereby allowing the pressure supplied via pipe 24*b* to fully close gate 22 by movement of piston 70.

Opening gate 64 results in a venting of the pressure supplied to cylinder 26 via pipe 24*b*, thereby allowing the pressure supplied via pipe 24*a* to fully open gate 22 by movement of piston 70. Since pressure supplied to the cylinder via pipe 24*a* is normally determined by the crimping chamber pressure, it is desirable to provide a bias pressure from relay 52 of a magnitude sufficient to open, and maintain opened, gate 22 in the absence of an elevated pressure signal from the stuffing chamber when valve 64 is open.

Opening gate 68 results in the venting of the entire system to atmospheric pressure.

The controller 25 is supplied with flow control valves 54 and 62. These valves act to dampen any sudden pressure changes in the system and thereby provide for smooth opening or closing of the gate 22.

In operation, yarn 12 is fed into crimping chamber 14 by means of a fluid, preferably steam, under constant pressure supplied to injector passages 10*a* to form a wad 16 of crimped yarn. The position of the wad 16 in the chamber, the wad density and the uniformity of wad extrusion from the crimping chamber are controlled by the position of the hinged flapper 22 in response to fluid pressure in the space above the wad which is sensed by controller 25 through pipe 24. The controller then regulates the movement of air cylinder 26 via air under pressure supplied to opposite ends of the cylinder 26 through pipes 24*a*, 24*b*. The air cylinder then locates hinged flapper 22. More particularly, the position of piston 70 is controlled by the relative forces present on either side of the piston. If the total force on the piston side of the cylinder (pressure in 24*b* times the area of the piston) is greater than the force on the rod side (pressure in 24*e* times the area of the rod side) then the rod will extend closing gate 22 until sufficient resistance is encountered to equal the force unbalance. This resistance is transmitted to the exiting wad. The wad exiting rate is affected by this gate force by virtue of it varying the friction forces restricting its movement to the gate area. As discussed below, provisions are made within controller 25 to allow for the complete opening or closing of gate 22 when necessary.

In the constant operation of controller 25, pressure supplied to cylinder 26 via pipes 24*a* and 24*b* is controlled to place piston 70, and thereby gate 22, at a constant and optimal position and closing force for the intended fiber crimping operation. This gate position will maintain the fiber within the crimping chamber at a constant amount and level, thereby resulting in uniform fiber treatment. Changes in the amount of fiber within the crimping chamber will result in adjustment of the gate 22 in order to adjust the amount of fiber in the chamber to the desired level.

The amount of fiber in the crimping chamber will directly determine the fluid pressure in the chamber. Since fluid, e.g., steam, is fed into the chamber at a constant pressure, a decrease or increase in fiber amount will result in a respective decrease or increase in the chamber fluid pressure. For example, a decrease in the level of fiber in the crimping chamber will result in a decreased chamber pressure; and, through the system described above, a net increase in gate closing force, thereby causing gate 22 to begin to close. This closing of gate 22 will cause the amount of fiber to increase in chamber 14, thereby increasing the chamber pressure until the desired fiber level and chamber pressure are reached.

Alternatively, an increase in the amount of fiber in the crimping chamber will result in gate closing force reduction until the correct fiber level and chamber pressure are obtained.

By maintaining a constant fiber level in the crimping chamber 14 as described above, a constant space is maintained above the fiber wad 16 in chamber 14 (as depicted in FIG. 2) which is advantageous in allowing for the development of a three-dimensional crimp in the fibers treated therein.

In a typical crimping operation, pressure regulator 66 would be set between 10–15 psig, regulator 60 would be set at about 14 psig, volume booster 50 would have a signal to response ratio of 1:1, and relay 52 would have an amplification ratio of 1:30 and a bias output of 2 psig.

We claim:

1. A yarn crimping process comprising: introducing a filamentary yarn to be crimped into one end of a crimping chamber by means of a current of fluid under constant pressure and at a temperature to set the filaments of the yarn and pack the yarns under pressure into a wad in the crimping chamber against the counter pressure of a discharge regulation means in the form of a hinged flapper; and controlling the wad position in the chamber to maintain a relatively constant space above the wad by controlling the position of the flapper in response to the fluid pressure above the wad to allow freedom of movement in all directions of the filamentary yarn in said space.

2. The process as defined in claim 1 wherein said yarn is introduced into said crimping chamber by means of a current of steam.

3. In a crimping apparatus that includes a crimping chamber having entrance and discharge ends and discharge regulation means in the form of a hinged flapper to regulate the discharge of yarn from the chamber, the improvement comprising: an injector having a passage therethrough for yarn, said passage being in communication with the entrance end of said crimping chamber; means for supplying heated fluid under constant pressure to the injector and in a direction to carry the yarn through the injector passage to the crimping chamber and pack the yarn into a wad in the crimping chamber against the counter pressure of the hinged flapper; and means for controlling the wad position by controlling the discharge regulation means in response to the fluid pressure in said chamber to maintain a relatively constant space above the wad.

4. The apparatus of claim 3 wherein said fluid is steam.

* * * * *